US007299782B2

(12) United States Patent
Netsu et al.

(10) Patent No.: US 7,299,782 B2
(45) Date of Patent: Nov. 27, 2007

(54) CYLINDER HEAD STRUCTURE FOR A MULTI-CYLINDER INTERNAL COMBUSTION ENGINE

(75) Inventors: Hironao Netsu, Kanagawa (JP); Shin Nomura, Kanagawa (JP)

(73) Assignee: Nissan Motor Co., Ltd., Yokohama-shi (JP)

( * ) Notice: Subject to any disclaimer, the term of this patent is extended or adjusted under 35 U.S.C. 154(b) by 0 days.

(21) Appl. No.: 11/515,706

(22) Filed: Sep. 5, 2006

(65) Prior Publication Data

US 2007/0062478 A1 Mar. 22, 2007

(30) Foreign Application Priority Data

Sep. 6, 2005 (JP) ..... 2005-257226

(51) Int. Cl.
*F02F 1/40* (2006.01)
*F01M 3/04* (2006.01)

(52) U.S. Cl. ..... 123/196 M; 123/193.5; 123/41.82 R

(58) Field of Classification Search ..... 123/196 M, 123/193.5, 193.3, 41.82 R
See application file for complete search history.

(56) References Cited

U.S. PATENT DOCUMENTS 5,852,992 A * 12/1998 Boggs et al. ..... 123/196 R
2005/0172917 A1* 8/2005 Betsch et al. ..... 123/41.82 R

FOREIGN PATENT DOCUMENTS

JP 2661319 10/1997
JP 2007-71065 * 3/2007

* cited by examiner

*Primary Examiner*—Hai Huynh
(74) *Attorney, Agent, or Firm*—Rader, Fishman & Grauer, PLLC

(57) ABSTRACT

A cylinder head structure for a multi-cylinder internal combustion engine that is mounted on a vehicle so that a cylinder alignment direction goes along a front-rear direction of the vehicle comprises a cylinder head side wall, an upper deck, and a rib. The cylinder head side wall projects on a periphery of the cylinder head and is provided along the cylinder alignment direction. The upper deck is formed on the cylinder head so as to be positioned between portions of the cylinder head side wall, wherein the upper deck further includes an oil return hole formed near a portion of the cylinder head side wall. The rib extends in a width direction of the cylinder head and is formed on the upper deck in a rear side of the oil return hole.

14 Claims, 3 Drawing Sheets

CYLINDER HEAD STRUCTURE FOR A MULTI-CYLINDER INTERNAL COMBUSTION ENGINE

CROSS-REFERENCES TO RELATED APPLICATION

This application claims priority from Japanese Patent Application Serial No. 2005-257226 filed Sep. 6, 2005, the content of which is incorporated herein by reference in its entirety.

TECHNICAL FIELD

Described herein is a cylinder head for an inline multi-cylinder internal combustion engine.

BACKGROUND

Conventionally, a multiplicity of bearing portions and sliding portions of an internal combustion engine for an automobile are lubricated with oil (lubricant oil), and oil return holes are formed on an upper deck of a cylinder head to drip the oil downwards. For example, as disclosed in Japanese Patent No. 2,661,319, a multiplicity of oil return holes are formed in alternation with the cylinders adjacent to a side wall of the cylinder head.

In such an inline multi-cylinder internal combustion engine mounted in an engine room of a vehicle, in which the cylinder line direction goes along the front-rear direction of the vehicle, since the oil on the upper deck flows swiftly, for example, during rapid acceleration toward the rear side of the engine, the oil hardly drips downwardly from the oil return holes located between the front side of the engine and the center of the engine. Thus, the oil easily accumulates on the upper deck on the rear side of the engine so that the amount of oil that can be circulated in the engine may be temporarily insufficient. In particular, a V-type multi-cylinder internal combustion engine, in which a pair of banks incline at a predetermined angle, has an upper deck on the cylinder heads, each of which inclines from the horizontal plane and therefore, the oil tends to accumulate near the rear side portion of the head side wall of the engine, which is located outside the bank, and at a relatively low level on the upper deck.

In addition to the oil return holes, head bolt bosses where head bolts are inserted to tighten the cylinder head and cylinder block, valve spring seat bosses that receive valve spring seats, and a secondary air passage that supplies secondary air to an exhaust passage, etc., are provided in a tightly packed manner, and therefore in order to secure the oil return performance without causing a reduction in rigidity or strength, or a size enlargement of the engine, it is very difficult to enlarge the aperture of each oil return hole or change its position.

SUMMARY

A cylinder head structure for a multi-cylinder internal combustion engine that is mounted on a vehicle so that a cylinder alignment direction goes along a front-rear direction of the vehicle comprises a cylinder head side wall, an upper deck, and a rib. The cylinder head side wall projects on a periphery of the cylinder head and is provided along the cylinder alignment direction. The upper deck is formed on the cylinder head so as to be positioned between portions of the cylinder head side wall, wherein the upper deck further includes an oil return hole formed near a portion of the cylinder head side wall. The rib extends in a width direction of the cylinder head and is formed on the upper deck in a rear side of the oil return hole.

When the oil on the upper deck tends to flow toward the rear side of the engine swiftly, for example, during rapid acceleration, part of the oil is received by the ribs and guided to the oil return holes thereby limiting the accumulation of the oil at the rear side of the engine on the upper deck, so that a temporary oil shortage due to the accumulation can be limited and avoided.

BRIEF DESCRIPTION OF DRAWINGS

Features and advantages of the present internal combustion engine will be apparent from the ensuing description, taken in conjunction with the accompanying drawings, in which.

DETAILED DESCRIPTION

While the claims are not limited to the illustrated embodiments, an appreciation of various aspects of the internal combustion engine is best gained through a discussion of various examples thereof.

Figure 1:
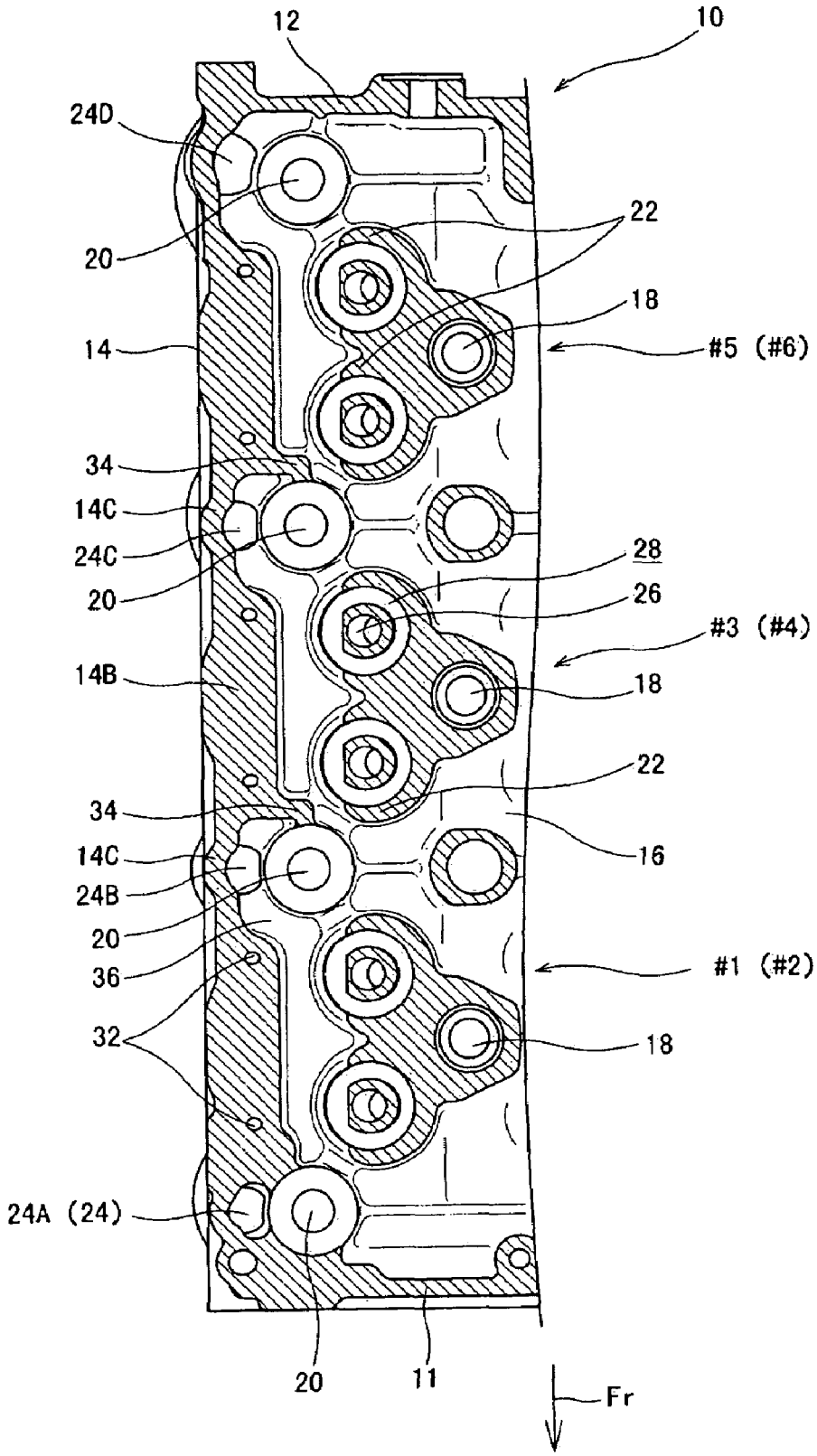
FIG. 1 is a lateral cross-sectional view that shows a cylinder head of a V-type internal combustion.
Figure 2:
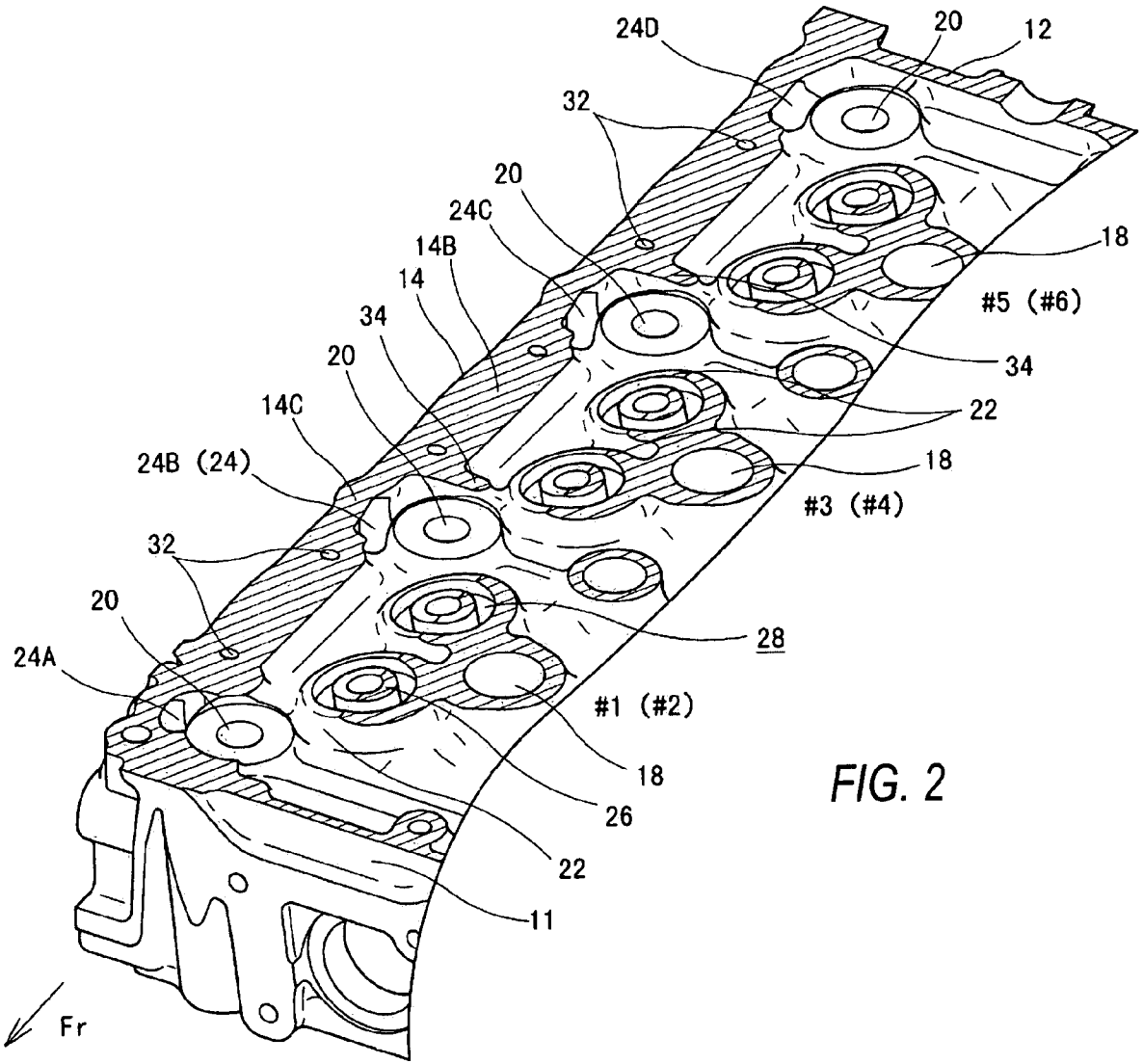
FIG. 2 is a perspective corresponding view of the cylinder head of FIG. 1, which is exposed above an upper deck.
Figure 3:
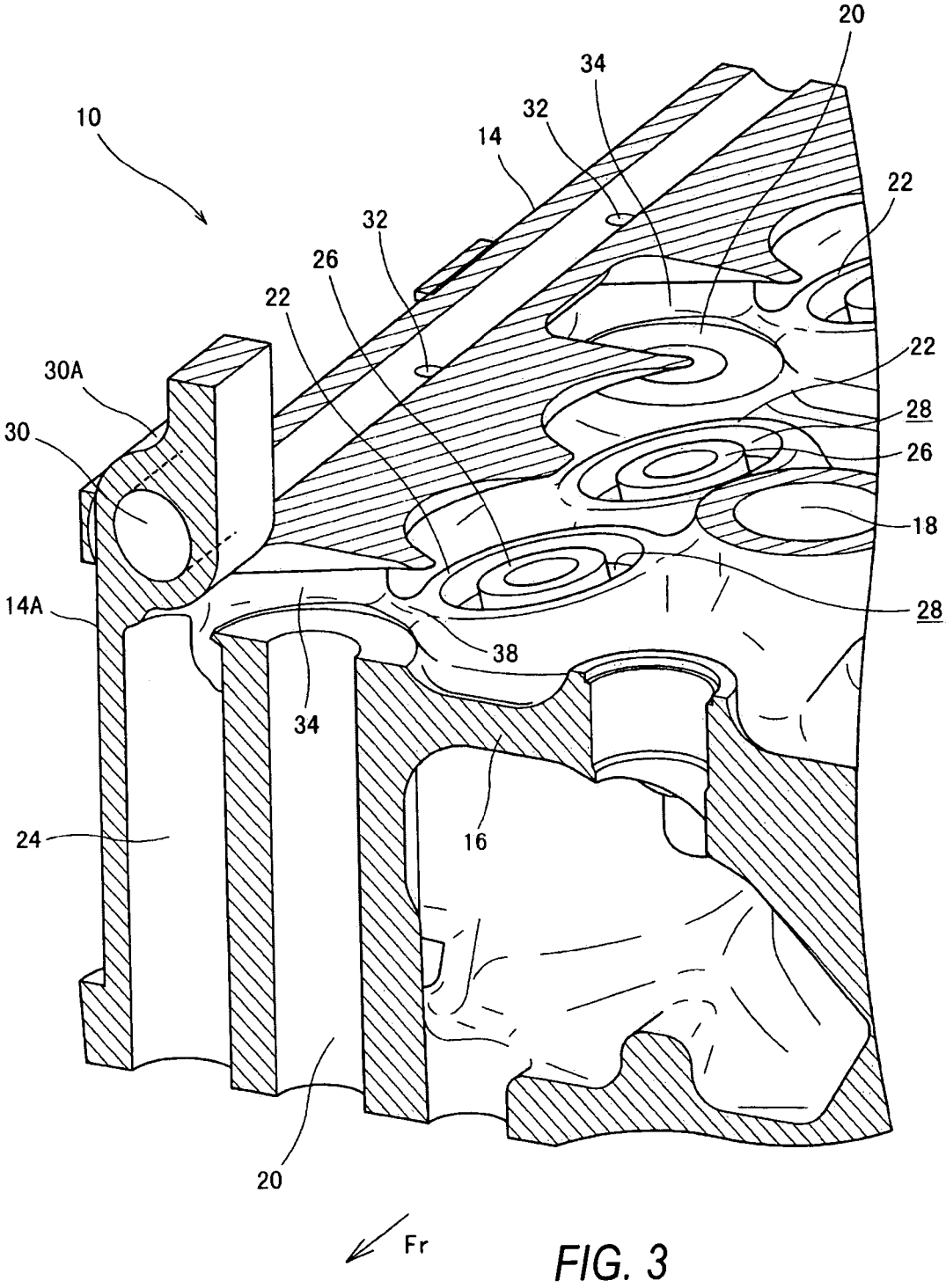
FIG. 3 is a cross-sectional view of a portion of the cylinder head of FIG. 1.

An embodiment will be described by referring to the drawings. FIGS. 1 to 3 are cross-sectional views of an inline type internal combination engine, in which a portion of a cylinder head 10 is shown. The internal combustion engine is mounted in a vehicle so that the cylinder line direction goes along the front-rear direction of the vehicle (direction that goes along the arrow Fr of FIG. 1) and is a V-type multi-cylinder internal combustion engine in which a pair of banks incline at a predetermined angle, and the cylinder head 10 is provided for each bank. In addition, this internal combustion engine is a 6-cylinder internal combustion engine that is comprised of three cylinders: #1, #3 and #5 (or #2, #4 and #6) per bank, in which the inside of the bank (on the right in FIG. 1) is located on the inlet valve side, and the outside of the bank (on the left in FIG. 1) is located on the exhaust valve side.

The cylinder head 10 is cast from an aluminum alloy or casting iron in an integrated manner, and has an approximate box shape, in which the four sides are surrounded by a head front wall 11 and head rear wall 12, which are in the front and back sides of the vehicle respectively, a head side wall on the inside of the bank (not shown), and the head side wall 14 which is located on the outside of the bank. In addition, an upper deck 16, where the valve lifter (valve guide) of an inlet valve and an exhaust valve are inserted, is formed on the top of the head. Moreover, as an example, ignition plug bosses 18, head bolt bosses 20, valve spring seat bosses 22 and oil return holes 24 (24A to 24D), which are open on the upper deck 16, are formed on the cylinder head 10. Each of the ignition plug bosses 18 has a cylinder shape that extends in the axis direction of each cylinder, and an ignition plug, which is provided at the top center of each cylinder, is inserted therein. The head bolt bosses 20 are provided at four positions along the head side wall 14 in alternation with the cylinders, and similarly additional head bolt bosses 20 are provided at four positions on the inside head side wall of the bank (not shown), so that a total of 8 head bolt bosses are provided. By head bolts that are inserted into the head bolt bosses 20, the cylinder head 10 and the cylinder block are fixed by tightening the cylinder head and cylinder block from both sides thereof via a gasket(s).

The valve spring seat bosses 22 are provided at four positions around an ignition plug boss 18 of each cylinder in correspondence to a pair of inlet valves and a pair of exhaust valves that are provided for each cylinder (in the figure, only two on the exhaust side are shown). A valve stem guide 26, with an approximately cylindrical shape that guides the up-and-down movement of the valve stem, is formed inside each of the valve spring seat bosses 22, and a valve spring seat that receives an edge of a valve spring is provided on an approximately ring-shaped concave portion 28 between the valve spring seat boss 22 and the valve stem guide 26.

The oil return holes 24 are provided immediately inside the head side wall 14, and as with the above-mentioned head bolt bosses 20, the holes 24 are provided at four positions (24A to 24D) in alternation with the cylinder along the head side wall 14 outside the bank.

As shown in FIG. 3, a main secondary air passage 30 and sub-secondary air passages 32 to supply secondary air (air) to the exhaust passage are formed in the head side wall 14. The main secondary air passage 30 is located above the head at a higher position than the upper deck 16 and extends in the cylinder line direction. In FIG. 3, a portion 30A of the head side wall 14, where the main secondary air passage 30 is formed, is partially curved toward the inside. A pair of exhaust ports per cylinder is formed below the upper deck 16. The sub-secondary air passage 32 connects the major secondary air passage 30 and each of the exhaust ports to each other, and two of them are provided per cylinder.

Operation and advantages of the present embodiment are described below.

(1) At least one rib 34 that extends in the width direction of the cylinder head (left and right directions in FIG. 1) is provided in the rear side of the vehicle (behind each of the oil return holes 24B and 24C on the upper deck 16). More specifically, among the four oil return holes 24A to 24D, which are provided in order along the head side wall 14 from the front side Fr of the engine, the ribs 34 are provided behind the oil return holes 24B and 24C located at the center of the engine. The ribs 34 are not provided for the oil return holes 24A and 24D which are located at the far front and far rear sides of the engine.

According to the structure of the embodiment, even if the oil on the upper deck 16 tends to flow toward the rear side of the engine swiftly, for example, during rapid acceleration, part of the oil is dammed by the ribs 34 and can be effectively guided to the oil return holes 24B and 24C, which are located immediately in front of the ribs 34. Therefore, the over-accumulation of oil around the oil return hole 24D at the far rear portion of the engine on the upper deck 16 during rapid acceleration, etc., can be effectively reduced or avoided, thereby stably securing the amount of oil during rapid acceleration, etc.

(2) If the oil return holes 24 are located diagonal to the rear side of the head bolt boss 20, that is, the head bolt bosses 20 are located diagonal to the front of the oil return hole, the bolt bosses 20 would become obstacles and hinder the flow of the oil toward the oil return holes 24. Therefore, according to the present embodiment, the oil return holes 24 are provided immediately beside the head bolt bosses 20 such that the holes 24 are arranged between the head bolt boss 20 and the head side wall 14. By doing so, a guide passage 36 that goes towards the oil return holes 24 (see FIG. 1) is formed between the peripheral surface of the head bolt boss 20 and the head side wall 14, and the oil can be more effectively guided to the oil return holes 24B and 24C when the oil on the upper deck 16 tends to flow to the rear side of the engine, for example, during rapid acceleration.

(3) The ribs 34 bridge over the rear end of the head bolt bosses 20 and the head side wall 14 respectively. Therefore, the oil that flows into and around the oil return holes 24B and 24C can be securely dammed by the ribs 34 which bridge over the rear end of the head bolt boss 20 and the head side wall 14, and much of the oil can be desirably guided to the oil return holes 24B and 24C. In addition, since the head bolt bosses 20, which are inherently rigid, and the head side wall 14 are connected by the ribs 34 respectively, the rigidity and strength of the head is further improved and the material flow during the casting (casting flow) can be improved as well.

(4) As shown in FIG. 3, the ribs 34 are smoothly connected to the valve spring seat bosses 22, respectively, that are provided on the upper deck 16 via connecting portions 38. Therefore, the rigidity and strength of the head at this portion can be further improved and the material flow during the casting (casting flow) can be increased as well.

(5) The main secondary air passage 30 that extends in the direction of the cylinder line is provided on the head side wall 14, and the oil return holes 24 are provided below the main secondary air passage 30, more specifically, right below the major secondary air passage 30. In other words, by efficiently using a space below the main secondary air passage 30 that overhangs toward the inside of the head, the oil return holes 24 are provided immediately beside the head bolt bosses 20, respectively. Because of this, a wall surface 14A of the head side wall 14 can be linearly formed adjacent to the main secondary air passage 30 to the oil return holes 24, as shown in FIG. 3, thereby allowing the realization of the above-mentioned layout practically without increasing the size in the width direction of the cylinder head 10.

(6) Furthermore, a multiplicity of sub-secondary air passages 32 that connect the main secondary air passage 30 and a pair of exhaust ports for each cylinder to each other are formed on the head side wall 14. As shown in FIG. 2, a portion 14B, where a pair of sub-secondary air passages 32 per cylinder is formed on the head side wall 14, is thickened, and the portions other than the thick portion 14B are thinned. The each of oil return holes 24 is provided immediately inside the thin portion 14C using a space formed between the thin portion 14C and the head bolt boss 20. The ribs 34 overhang toward the inside of the head from the thick portion 14B that is connected to the rear portion of the thin portions 14C. In other words, the front wall of the thick portion 14B also serves as a portion of the ribs 34 that guides the oil to the oil return holes.

(7) In a V-type multi-cylinder internal combustion engine in which a pair of banks incline at a predetermined angle, the entire upper deck 16 of the cylinder head 10 is inclined from the horizontal plane so that the outside of the bank becomes lower, and therefore the oil tends to accumulate near the head side wall 14 outside the bank. Therefore, it is preferable, as described in the above-mentioned embodiment, that the ribs 34 are formed adjacent to the outside of the cylinder head in the width direction, that is, adjacent to the head side wall 14 and the outside of the bank.

(8) Moreover, the oil return hole 24D at the far rear portion of the engine is formed so as to have a larger aperture than those of the three oil return holes 24A to 24C. Therefore, it is possible to further securely avoid the accumulation of oil at the rear side of the engine on the upper deck 16 during rapid acceleration, etc.

As long as an inline type internal combustion engine is provided, the internal combustion engine, to which the present cylinder head is applied, is not limited to a V-type 6 cylinder type engine, as in the above-mentioned embodiments. Thus, a serial multi-cylinder internal combustion engine, etc., is also acceptable.

The preceding description has been presented only to illustrate and describe exemplary embodiments of the internal combustion engine according to the claimed invention. It is not intended to be exhaustive or to limit the invention to any precise form disclosed. It will be understood by those skilled in the art that various changes may be made and equivalents may be substituted for elements thereof without departing from the scope of the invention. In addition, many modifications may be made to adapt a particular situation or material to the teachings of the invention without departing from the essential scope. Therefore, it is intended that the invention not be limited to the particular embodiment disclosed as the best mode contemplated for carrying out this invention, but that the invention will include all embodiments falling within the scope of the claims. The invention may be practiced otherwise than is specifically explained and illustrated without departing from its spirit or scope. The scope of the invention is limited solely by the following claims.

What is claimed is:

1. A cylinder head structure for a multi-cylinder internal combustion engine that is mounted on a vehicle so that a cylinder alignment direction goes along a front-rear direction of the vehicle comprising:

a cylinder head side wall projecting on a periphery of the cylinder head, the cylinder head side wall being provided along the cylinder alignment direction;

an upper deck formed on the cylinder head so as to be positioned between portions of the cylinder head side wall, wherein the upper deck further includes an oil return hole formed near a portion of the cylinder head side wall; and a rib that extends in a width direction of the cylinder head and is formed on the upper deck in a vehicle rear side of the oil return hole.

2. The cylinder head structure for a multi-cylinder internal combustion engine according to claim 1, wherein a head bolt boss is provided on the upper deck in the cylinder alignment direction, and the oil return hole is provided adjacent the head bolt boss and between the head bolt boss and the cylinder head side wall.

3. The cylinder head structure for a multi-cylinder internal combustion engine according to claim 2, wherein the rib bridges between a rear end of the head bolt boss and the cylinder head side wall.

4. The cylinder head structure for a multi-cylinder internal combustion engine according to claim 1, wherein a valve spring seat boss is provided on the upper deck, and the rib is connected to the valve spring seat boss.

5. The cylinder head structure for a multi-cylinder internal combustion engine according to claim 1, wherein a main secondary air passage that extends in the cylinder alignment direction is provided on the cylinder head side wall, and the oil return hole is provided below the main secondary air passage for the internal combustion engine.

6. The cylinder head structure for a multi-cylinder internal combustion engine according to claim 5, wherein a sub-secondary air passage is formed on the cylinder head side wall, and the sub-secondary air passage connects between the main secondary air passage and an exhaust port for one of the cylinders.

7. The cylinder head structure for a multi-cylinder internal combustion engine according to claim 1, wherein the internal combustion engine is a V-type engine having a pair of banks that incline with each other at a predetermined angle, and the oil return hole is formed near the cylinder head side wall and an outside of one of the banks.

8. The cylinder head structure for a multi-cylinder internal combustion engine according to claim 1, wherein the rib is smoothly connected to a valve spring seat boss.

9. The cylinder head structure for a multi-cylinder internal combustion engine according to claim 1, wherein the rib overhangs toward an inside of the cylinder head from a thick portion of the cylinder head side wall so that the thick portion serves as a portion of the rib.

10. The cylinder head structure for a multi-cylinder internal combustion engine according to claim 1, wherein two or more of the oil return holes are provided in the upper deck.

11. The cylinder head structure for a multi-cylinder internal combustion engine according to claim 10, wherein one of the two or more of the oil return holes is located at a far rear side of the engine.

12. The cylinder head structure for a multi-cylinder internal combustion engine according to claim 11, wherein the one of the two or more of the oil return holes has a larger aperture than the other oil return holes.

13. A cylinder head structure for a multi-cylinder internal combustion engine that is mounted on a vehicle so that a cylinder alignment direction goes along a front-rear direction of the vehicle comprising:

an upper deck means for allowing oil flowing on a deck; and a guiding means is provided in a vehicle rear side of the oil return hole.

14. A method of limiting accumulation of oil in a cylinder head for a multi-cylinder internal combustion engine that is mounted on a vehicle so hat a cylinder alignment direction goes along a front-rear direction of the vehicle, the method comprising:

providing a cylinder head that includes an upper deck formed near a cylinder head side wall provided along the cylinder alignment direction, wherein the upper deck further comprises an oil return hole;

positioning a rib that extends in a width direction of the cylinder head on the upper deck in a vehicle rear side of the oil return hole; and wherein the rib receives a portion of the oil and guides the oil that flows toward the rear side of the engine to the oil return hole.

* * * * *

UNITED STATES PATENT AND TRADEMARK OFFICE

CERTIFICATE OF CORRECTION

PATENT NO. : 7,299,782 B2
APPLICATION NO. : 11/515706
DATED : November 27, 2007
INVENTOR(S) : Netsu et al.

It is certified that error appears in the above-identified patent and that said Letters Patent is hereby corrected as shown below:

Col. 6, Claim 14, line 46, please change [hat] to <u>that.</u>

Signed and Sealed this

Twenty-fifth Day of March, 2008

JON W. DUDAS
*Director of the United States Patent and Trademark Office*